US010744352B2

(12) United States Patent
Tucker et al.

(10) Patent No.: US 10,744,352 B2
(45) Date of Patent: Aug. 18, 2020

(54) HALF FACEPIECE

(71) Applicant: Scott Technologies, Inc., Boca Raton, FL (US)

(72) Inventors: Carl Estcourt Tucker, Conwy (GB); John Slemmen, Merseyside (GB); Gareth Dyfan Evans, Wrexham (GB); Garath Tudor Roberts, Wrexham (GB); Chris Ward, Denbigshire (GB); Troy Alan Baker, Denbigshire (GB); Graham Peter Wilson, Flintshire (GB); Robert Charles Sutton, Merseyside (GB); Amy Elizabeth Quiring, Matthews, NC (US); Michael Parham, Weddington, NC (US); Nigel Holmes, Lancashire (GB)

(73) Assignee: Scott Technologies, Inc., Monroe, NC (US)

( * ) Notice: Subject to any disclaimer, the term of this patent is extended or adjusted under 35 U.S.C. 154(b) by 1027 days.

(21) Appl. No.: 14/528,114

(22) Filed: Oct. 30, 2014

(65) Prior Publication Data

US 2015/0047642 A1 Feb. 19, 2015

Related U.S. Application Data

(63) Continuation of application No. PCT/US2013/038820, filed on Apr. 30, 2013.

(60) Provisional application No. 61/640,515, filed on Apr. 30, 2012.

(51) Int. Cl.

| | |
|---|---|
| ***A62B 23/02*** | (2006.01) |
| ***A62B 18/02*** | (2006.01) |
| ***A62B 7/10*** | (2006.01) |
| ***A62B 18/08*** | (2006.01) |

(52) U.S. Cl.

CPC ..... *A62B 23/025* (2013.01); *A62B 7/10* (2013.01); *A62B 18/025* (2013.01); *A62B 23/02* (2013.01); *A62B 18/084* (2013.01)

(58) Field of Classification Search

CPC .. A61M 16/105; A61M 16/107; A61M 16/06; A61M 16/0605; A61M 16/0688; A41D 13/11; A41D 13/1107; A41D 13/1138; A41D 13/1169; A41D 13/1176; A62B 7/10; A62B 18/02; A62B 18/025; A62B 23/02; A62B 23/025

See application file for complete search history.

(56) References Cited

U.S. PATENT DOCUMENTS 1,502,450 A * 7/1924 Wood ..... A41D 13/1146 128/206.13
2,035,097 A * 3/1936 Schwartz ..... A62B 23/02 55/486

(Continued)

FOREIGN PATENT DOCUMENTS

EP 0258508 A1 3/1988
WO WO 2010070495 A1 * 6/2010 ..... A61M 16/06
WO WO-2011051462 A2 * 5/2011 ..... A61M 16/0066

*Primary Examiner* — Kathryn E Ditmer

(57) ABSTRACT

A semi-disposable face mask has a shaped molded base composed of silicone and/or TPE and molded forming a face seal, a filter media and a support structure that houses the shaped molded base and filter media in fluid communication allowing airflow from an environment through the filter media to the face seal.

9 Claims, 7 Drawing Sheets

(56) References Cited

U.S. PATENT DOCUMENTS 2,578,007 A * 12/1951 Hill ..... A41D 13/11 128/206.17
2,798,483 A * 7/1957 Kashima ..... A62B 18/10 128/206.13
2,845,926 A * 8/1958 Hill ..... A62B 23/025 128/206.17
3,014,479 A * 12/1961 Matheson ..... A41D 13/1146 128/206.15
3,137,296 A * 6/1964 Gurtowski ..... A41D 13/1146 128/206.12
3,154,073 A * 10/1964 Klinger ..... A41D 13/11 128/206.12
3,276,445 A * 10/1966 Langdon ..... A62B 23/025 128/206.15
3,521,630 A * 7/1970 Westberg ..... A62B 23/025 128/206.15
4,248,220 A 2/1981 White
4,414,973 A * 11/1983 Matheson ..... A62B 18/00 128/206.15
4,514,197 A * 4/1985 Armbruster ..... B01D 53/02 55/385.2
4,592,350 A * 6/1986 Maryyanek ..... A62B 23/02 128/206.17
4,630,604 A * 12/1986 Montesi ..... A62B 18/025 128/206.15
4,688,567 A * 8/1987 Kikuchi ..... A62B 23/02 128/206.15
4,850,346 A * 7/1989 Michel ..... A62B 18/025 128/206.15
4,856,509 A 8/1989 Lemelson
4,981,134 A * 1/1991 Courtney ..... A62B 18/025 128/206.15
D320,677 S * 10/1991 Kumagai ..... D24/110.1
5,226,412 A * 7/1993 Winters ..... A62B 23/00 128/205.29
5,337,739 A * 8/1994 Lehman ..... A61B 5/097 128/205.27
5,340,149 A * 8/1994 Gajewski ..... B60R 21/215 280/728.3
5,353,789 A * 10/1994 Schlobohm ..... A62B 18/025 128/206.17
5,372,130 A * 12/1994 Stern ..... A62B 18/006 128/205.25
5,427,092 A * 6/1995 Shiao ..... A62B 23/00 128/205.29
5,540,223 A * 7/1996 Starr ..... A61M 16/06 128/205.25
5,669,375 A * 9/1997 Dahrendorf ..... A62B 23/02 128/205.29
6,176,239 B1 * 1/2001 Grove ..... A62B 18/02 128/201.15
RE39,493 E * 2/2007 Yuschak ..... A62B 23/02 128/201.25
7,237,550 B1 * 7/2007 Lin ..... A62B 18/025 128/205.27
2002/0026776 A1 * 3/2002 McNaughton ..... B01D 46/0005 55/495
2003/0029454 A1 * 2/2003 Gelinas ..... A62B 18/025 128/205.27
2004/0226563 A1 * 11/2004 Xu ..... A62B 18/02 128/206.21
2006/0196510 A1 * 9/2006 McDonald ..... A61M 16/06 128/206.21
2008/0063575 A1 3/2008 Paolucci
2008/0156329 A1 7/2008 Brunell
2009/0078265 A1 3/2009 Skulley
2009/0090364 A1 4/2009 Behymer
2009/0194109 A1 * 8/2009 Doshi ..... A61M 16/0051 128/204.23
2009/0293730 A1 * 12/2009 Volo ..... B01D 46/0023 96/222
2010/0218761 A1 * 9/2010 Flannigan ..... A62B 18/025 128/201.19
2011/0247626 A1 * 10/2011 Chuang ..... A62B 23/02 128/206.19
2012/0090615 A1 4/2012 Chen
2012/0125341 A1 * 5/2012 Gebrewold ..... A62B 18/025 128/206.12
2012/0174922 A1 * 7/2012 Virr ..... A61M 16/0066 128/203.12
2012/0199130 A1 * 8/2012 Euvrard ..... A62B 7/14 128/206.17
2012/0260920 A1 * 10/2012 Choi ..... A62B 18/025 128/206.12
2012/0285454 A1 * 11/2012 Nibu ..... A61M 16/0066 128/204.18
2012/0325221 A1 * 12/2012 Tran ..... A62B 18/025 128/206.17

* cited by examiner

HALF FACEPIECE

CROSS-REFERENCE TO RELATED APPLICATIONS

This application is a continuation of International Application No. PCT/US13/38820 filed Apr. 30, 2013, which claims the benefit of U.S. Provisional Patent Application No. 61/640,515 filed Apr. 30, 2012, the contents of which are incorporated herein by reference.

FIELD OF THE INVENTION

The invention relates generally to semi-disposable face masks with improved face seal compositions and characteristics useful in protective equipment for emergency personnel or industrial work.

SUMMARY OF THE PRESENT INVENTION

A semi-disposable face mask has a shaped molded base composed of silicone and/or TPE and molded forming a face seal, a filter media and a support structure that houses the shaped molded base and filter media in fluid communication allowing airflow from an environment through the filter media to the face seal.

BRIEF DESCRIPTION OF THE DRAWINGS

The accompanying drawings, which are incorporated herein and constitute part of this specification, illustrate exemplary embodiments of the invention, and together with the description above, serve to explain further features of the invention.

DETAILED DESCRIPTION OF THE PREFERRED EMBODIMENT

Figure 1:
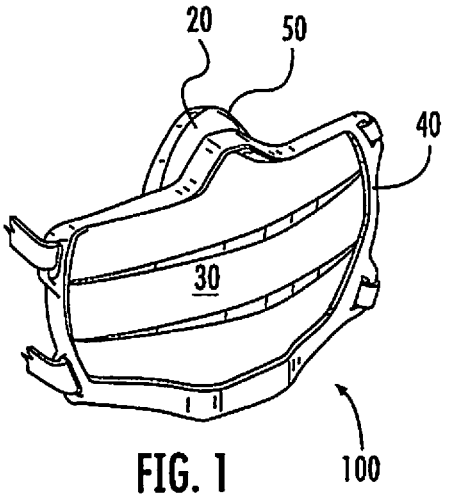
FIG. 1 illustrates a mask of the invention having a base, filter, framing member and support member.
Figure 2:
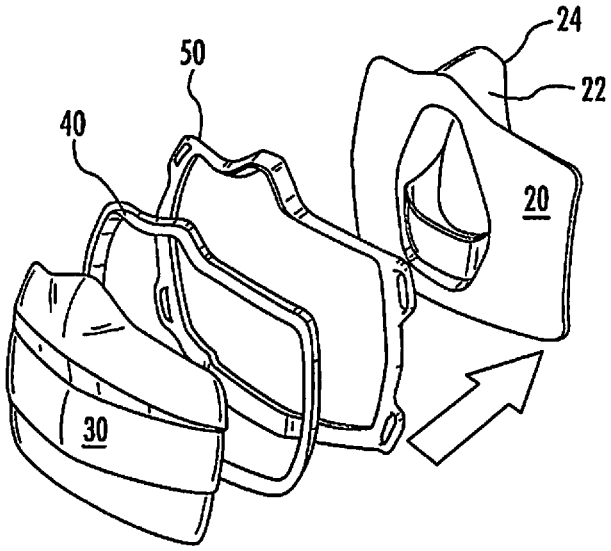
FIG. 2 illustrates an expanded view of the mask shown in FIG. 1.

The invention includes improvements in mask wear and decontamination. Referring to FIGS. 1 and 2, a hybrid disposable mask 100 includes a shaped molded base 20 forming a face seal 22 with a sealing edge 24 for contact with the wearer's face. The shaped molded base 20, face seal 22 and sealing edge 24 preferably have a composition of silicone, thermoplastic elastomer (TPE) or combination thereof. Silicone and TPE materials include any appropriate silicone rubber or thermoplastic rubbers having thermoplastic and elastomeric properties appropriate for facial contact and filter support. The sealing edge 24 of the face seal 22 provides a comfortable fit and wear of the mask 100 to the wearer. Generally the molded sealing edge 24 includes a rounded and/or textured edge for a comfortable facial contact to increase the area of contact with the wearer's face for extended times of use, although various seal profile options may be used in the face seal 22 design. Representative examples of the face seal 22 include, without limitation, a flat seal, reverse reflex, standard reflex and other like configurations for facial comfort. The face seal 22 is preferably configured to allow a single size to fit most personnel using the device which is enhanced with the elastic composition of the silicone or TPE material allowing a very flexible arrangement and fitting. The face seal 22 provides an improved mass or physical wear features for long term use of the mask 100.

As additionally seen in FIGS. 1 and 2, a filter media 30 may be combined with the shaped molded base 20 in the hybrid disposable mask 100. The filter media 30 includes any appropriately constructed filter for a given use. Representative examples include, without limitation, pleated, sheet, molded, layered, or other planar formed filter media fixable within a framing structure. The filter media 30 may include the general form of a relatively flat or contoured face panels. Shapes include oval, rectangular, curved, pentagonal, etc. with the shape matching a framing structure and the shaped molded base 20 effectively to ensure an airtight seal of the mask 100. Typically, a pleated filter may provide a feel and texture similar to a fabric and allows the body of the face mask to expand outwardly and generally conform to the wearer's face so as to loosely cover the nose and mouth of a wearer. Filters 30 may be single, layered, or preferably comprise a sandwich of several layers, such as an outer facing layer, an intermediate filter media layer, and an inner facing layer. The filter media 30 may include an inner and outer layer with a binder material to impart stiffness to the sheet during use. The filter media 30 may include a replaceable filter media or washable filter media. In one preferred embodiment, the filter media 30 includes a high efficiency filtering media typically used in the medical or research field.

The filter media 30 is positioned within a framing member 40 to maximize the filter media 30 area and to ensure optimum efficiency of the filter during use. This framing member 40 is attachable/detachable to a support structure 50 when in use. The framing member 40 preferably matches the perimeter of the filter media 30 and the support structure 50, allowing for the filter media 30 to remain as expanded as possible. The framing member 40 may be attached to the support structure through any appropriate locking mechanism, such as without limitation, latches, fictional contact, overhangs, pivot surfaces, twist insertions and the like, with fictional contact preferred. The framing member 40 provides a rigid structure to retain the filter media 30 in a given shape while allowing attachment to the support structure 50 without significant distortions of the shape.

The shaped molded base 20 attaches to the support structure 50, to maximize the area of the shaped molded base 20 and comfort of the user. The perimeter of the support structure 50 is generally similar to the perimeter of the shaped molded base 20, and the framing member 40 containing the filter media 30.

In operation, the assembled mask 100 is used within a work environment. After use the mask 100 is disassembled by detaching the framing member 40 (holding the filter media 30) from the support structure 50. The filter media 30 is removed from the framing member 40 and decontaminated or disposed of, as appropriate. The shaped molded base 20 is removed from the support structure 50, allowing both the shaped molded base 20 and support structure 50 to be thoroughly decontaminated. Additionally, the framing member 40, without the filter media 30 present, is decontaminated. Once decontaminated, the shaped molded base 20, framing member 40 and support structure 50 are reassembled into the mask 100 with either the decontaminated filter media 30 or new filter media 30. As such the invention provides a reuse and repeated disinfection durability, low breathing resistance as it includes a large area filter, improved protection and respirator fit.

Figure 3:
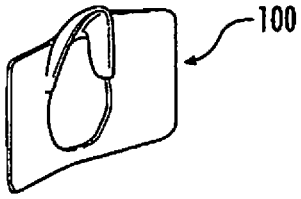
FIG. 3 illustrates a mask of the invention having a base, filter and support member.
Figure 4:
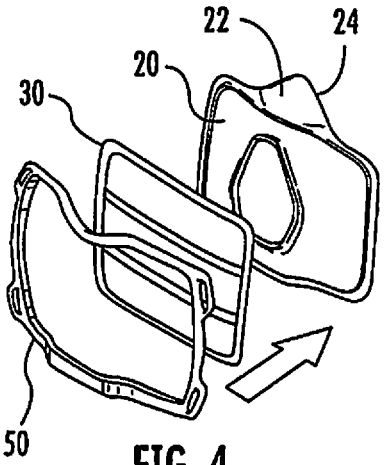
FIG. 4 illustrates an expanded view of the mask shown in FIG. 3.

In an alternative embodiment, shown in FIGS. 3 and 4, the invention includes the shaped molded base 20 attached to the support structure 50 with the filter media 30 therebetween. The filter media 30 is combined to the user's side of the support structure 50, and the shaped molded base 20 is then applied. In operation, the assembled mask 100 is used within a work environment. After use the mask 100 is disassembled by detaching the support structure 50 (holding the filter media 30) from the shaped molded base 20. The filter media 30 is removed from the support structure 50 and decontaminated or disposed of, as appropriate. The shaped molded base 20, being removed from the support structure 50, allows both the shaped molded base 20 and support structure 50 to be thoroughly decontaminated. Once decontaminated, the shaped molded base 20 and support structure 50 are reassembled into the mask 100 with either the decontaminated filter media 30 or new filter media 30.

Figure 5:
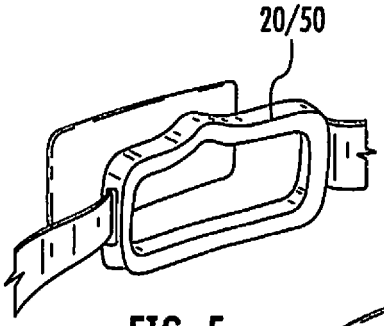
FIGS. 5-7 illustrate construction and use of a mask of the invention having a base/support structure and filter.
Figure 6:
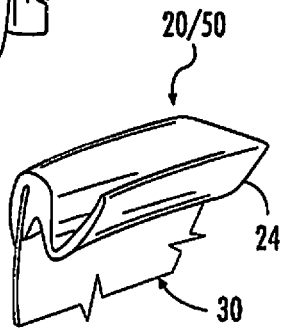
Figure 7:
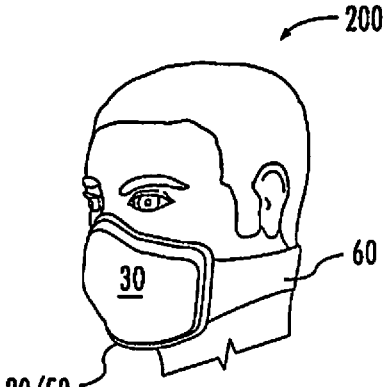

In an alternative embodiment, shown in FIGS. 5-7, the invention includes the shaped molded base 20 forming the support structure 50 with the filter media 30 inserted into a ridge 66 in the shaped molded base 20/support structure 50 as seen in FIG. 6. The filter media 30, once inserted, is held in place over the user's 200 nose and mouth with a strap 60, shown in FIG. 7. In operation, the assembled mask 100 is used within a work environment. After use the mask 100 is disassembled by detaching the filter media 30 from the shaped molded base 20/support structure 50. Removed filter media 30 is decontaminated or disposed of, as appropriate. The shaped molded base 20/support structure 50 is thoroughly decontaminated. Once decontaminated, the shaped molded base 20/support structure 50 is reassembled into the mask 100 with the insertion of either the decontaminated filter media 30 or new filter media 30.

Figure 8:
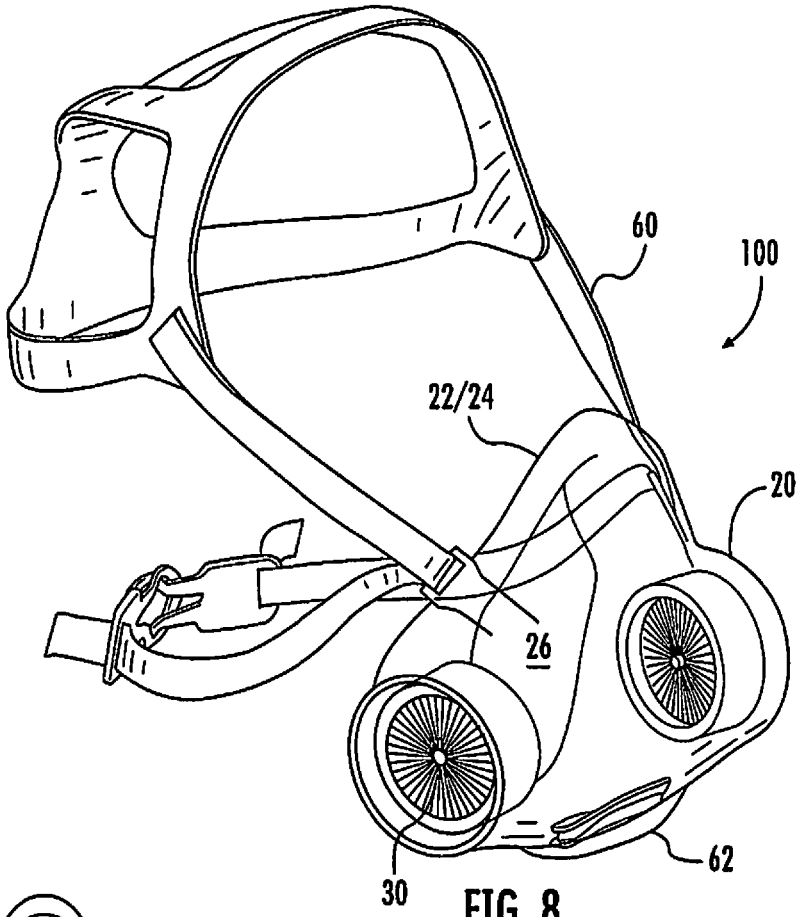
FIGS. 8-9 illustrate an embodiment of the invention.
Figure 9:
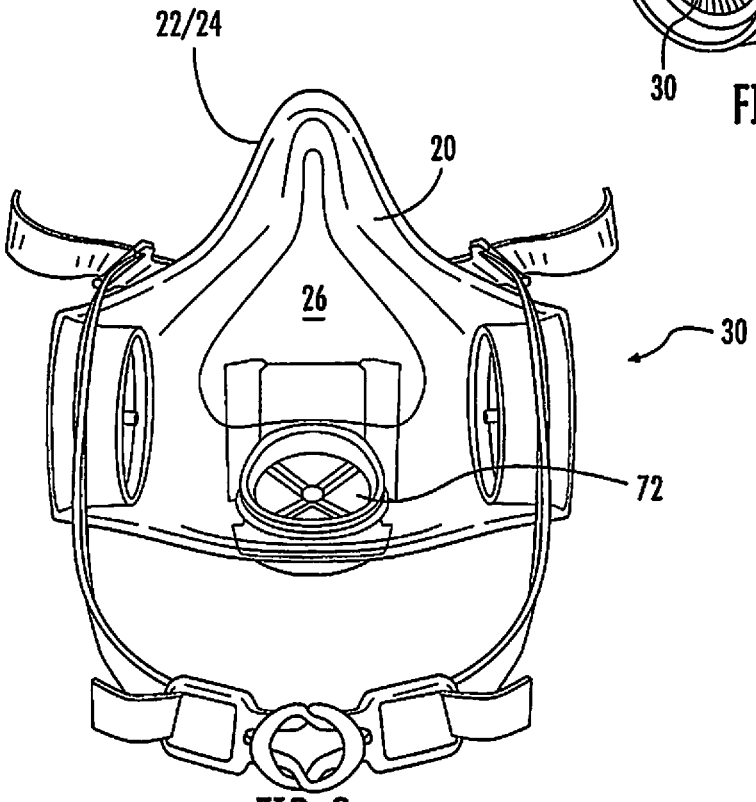

In the embodiment of the invention shown in FIGS. 8 and 9, the mask 100 includes filter media 30 that is preferably a replaceable and washable synthetic media having low breathing resistance filter pleating and media. The mask 100 includes an easy check and negative fit checking with hands as known by those skilled in the respirator arts. Additionally, a flexible and one size fits all head cradle 60 is readily cleaned, along with co-molded seal materials, smooth profile translucent oronasal 26. The mask 100 includes a downward facing exhale valve 72 and light weight assembly. In operation, the assembled mask 100 is used within a work environment. After use the mask 100 is disassembled by detaching the filter media 30) from the shaped molded base 20. The filter media 30 is removed and decontaminated or disposed of, as appropriate. The shaped molded base 20 is thoroughly decontaminated. Once decontaminated, the shaped molded base 20 is reassembled into the mask 100 with either the decontaminated filter media 30 or new filter media 30. As such the invention provides the mask 100 with easy disinfection, reuse and repeated disinfection durability, while additionally having a smooth external profile, improved breathing resistance, improved gauging fit, improved visual field, improved facial pressure using co-molded seal materials, improved air exchange having downward facing exhalation, improved mass or physical wear features, and improved facial visualization.

Figure 10:
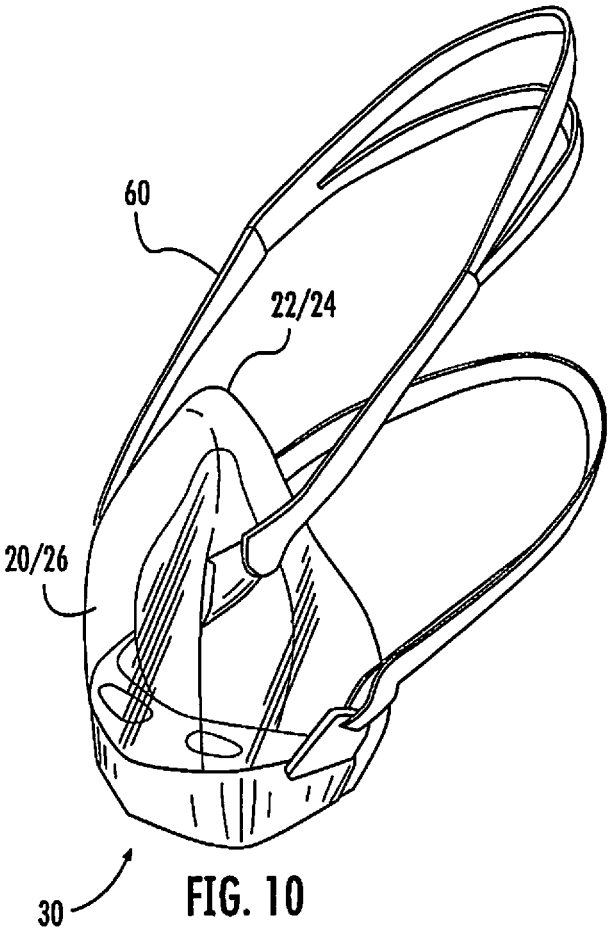
FIGS. 10-13 illustrate improvements in replaceable and washable filter media.
Figure 11:
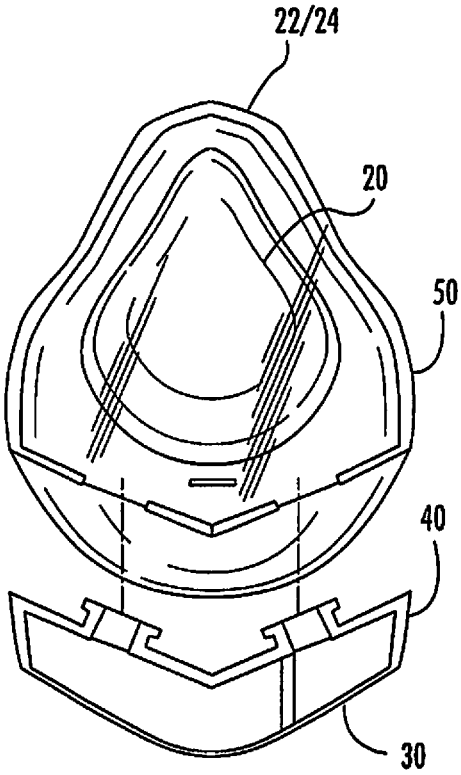
Figure 12:
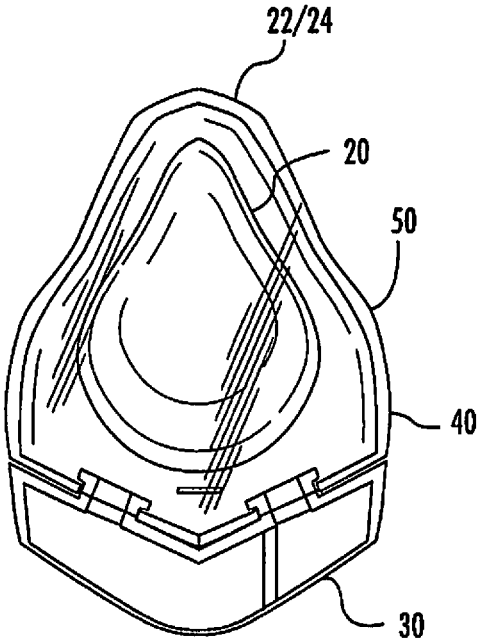
Figure 13:
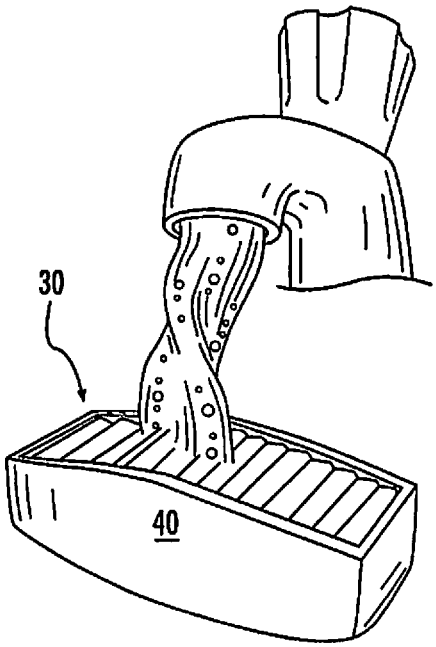

As seen in FIGS. 10-13, the invention includes the mask 100 with improved transmission reduction having single co-molded inhalation/exhalation filter 30. Referring to FIGS. 10-12, the mask 100 includes replaceable and washable filter media 30 (with decontamination filter media 30 shown in FIG. 13), that has a low breathing resistance filter media 30 installed into a low profile clear 26 silicone and/or TPE oronasal mask 100. The shaped molded base 20 is permanently fixed within a support structure 50, and the filter media 30 is placed, either permanently or temporarily, within the framing member 40.

In operation, the assembled mask 100 shown in to FIGS. 10-12 is used within a work environment. After use the mask 100 is disassembled by detaching the framing member 40 (holding the filter media 30) from the support structure 50. The filter media 30 may be removed from the framing member 40 if appropriate, or left intact within the framing member 40, and decontaminated or disposed of, as appropriate. The shaped molded base 20 and support structure 50 are thoroughly decontaminated. Additionally, the framing member 40, when the filter media 30 is removable, is decontaminated (shown in FIG. 13). When the filter media 30 is not removable from the framing member 40, it may be discarded for decontaminated when appropriate. Once decontaminated, the shaped molded base 20 and support structure 50 are reassembled into the mask 100 with either the decontaminated framing member 40 and filter media 30 or the decontaminated framing member 40 and new filter media 30. As such the mask 100 includes reuse and repeated disinfection durability, and improvements in breathing resistance, fomite transmission with the use of filtered exhalation, gauging fit, visual field and facial visualization.

Figure 14:
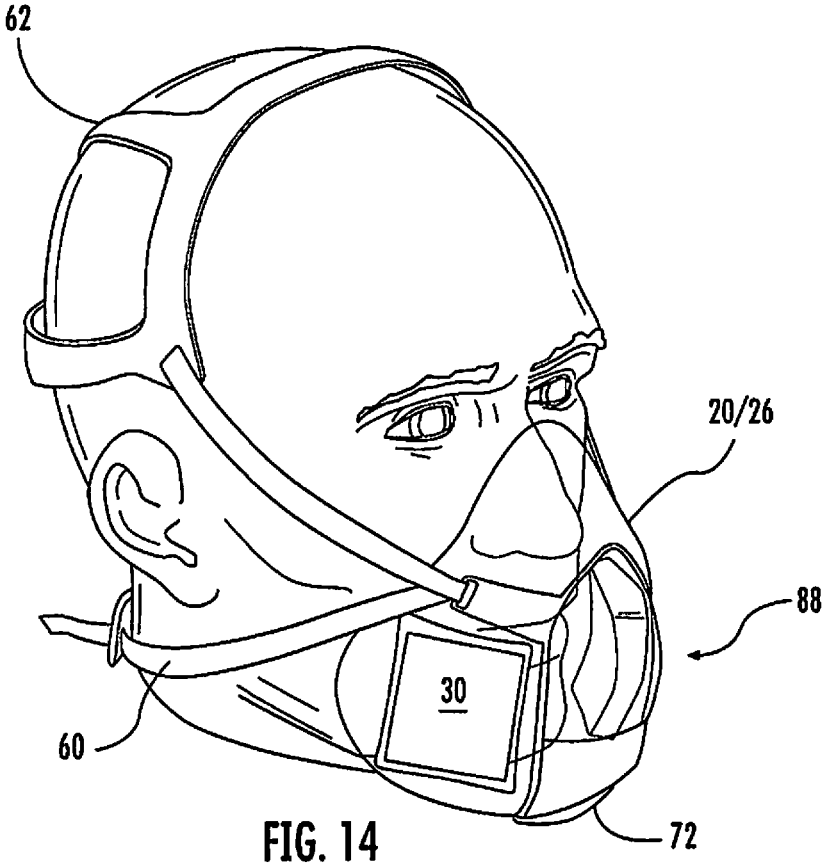
FIGS. 14-16 illustrate improvements in adaptive fit.
Figure 15:
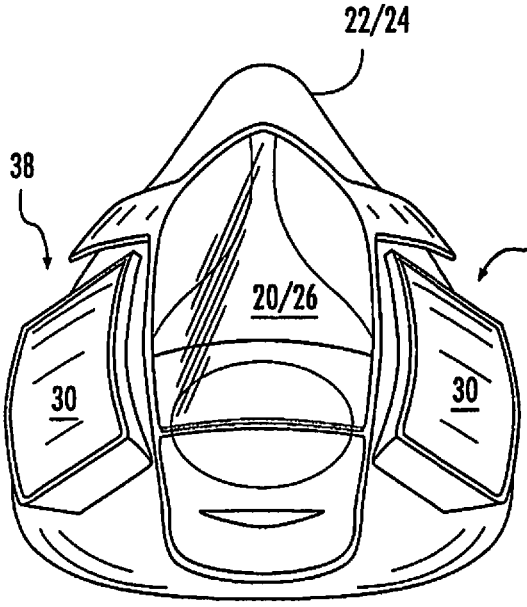
Figure 16:
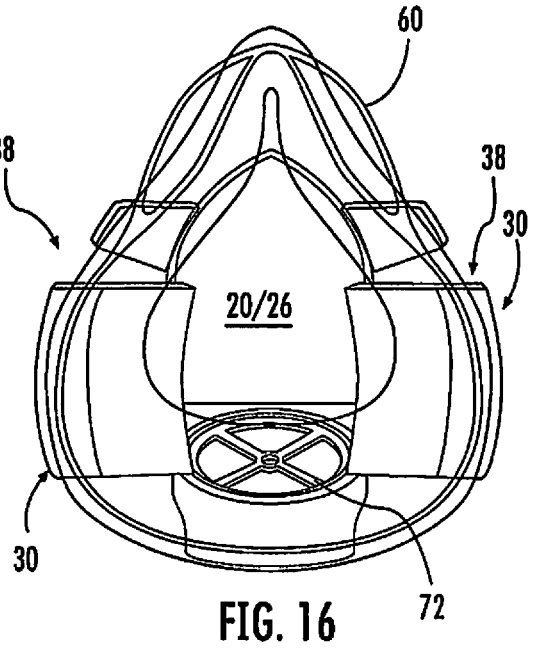

As seen in FIGS. 14-16, the invention includes the mask 100 with improvements in adaptive fit having flexible and one size fits all head cradle 62 that is easily cleaned. The mask 100 includes a smooth profile oronasal with a shaped molded base 20 having a clear 28 front for good user recognition. The mask 100 has a downward facing exhale valve 72 and an easy check and negative fit checking with hands. Filter media 30 of the mask 100 is replaceable and washable. The mask 100 provides a light weight assembly. Flap valves 38 direct air over clear section for potential de-misting and in-mold wire for face formability. The mask 100 provides reuse and repeated disinfection durability and improvements in speech intelligibility, breathing resistance, visual field, protection and respirator fit or adaptive fit, and facial visualization.

Figure 17:
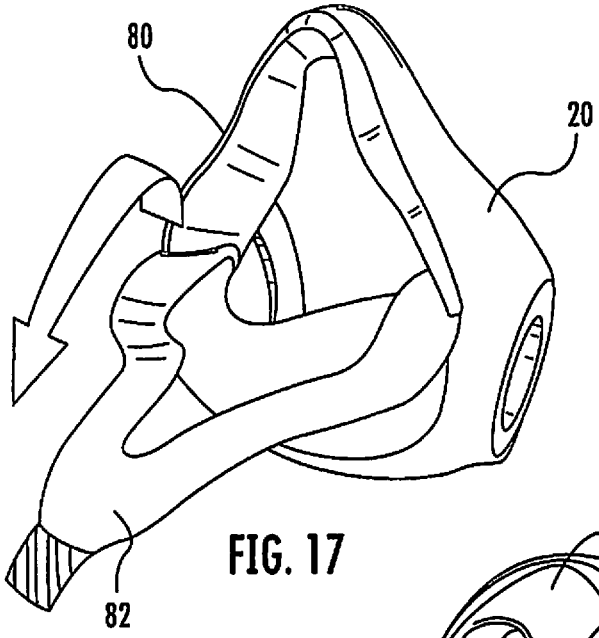
FIGS. 17-20 illustrate various improvements of the invention.
Figure 18:
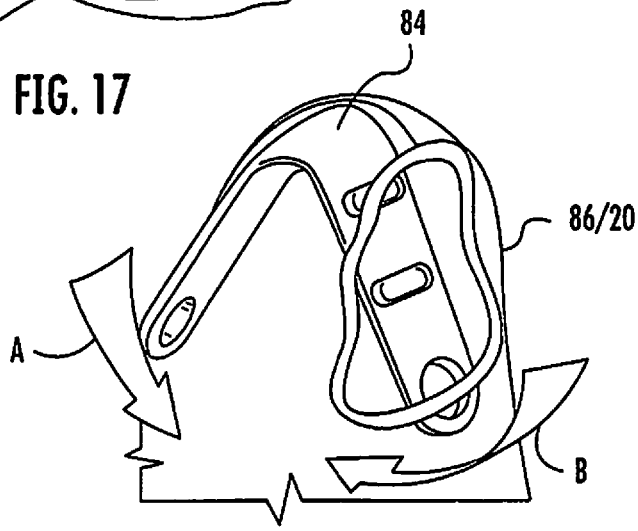
Figure 19:
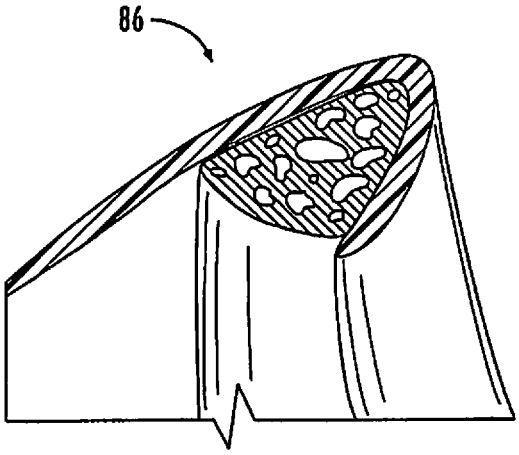
Figure 20:
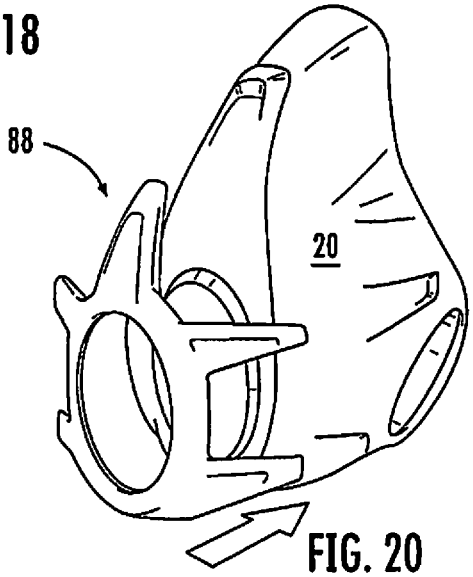
Figure 21:
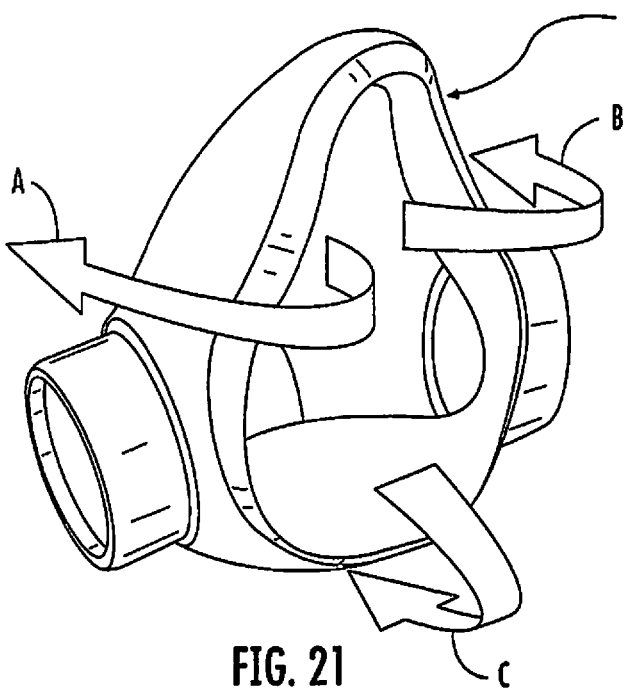
FIGS. 21-24 illustrate improvements in the composition of the invention; and, FIGS. 25-29 illustrate PAPR adaptations combined with the invention.
Figure 22:
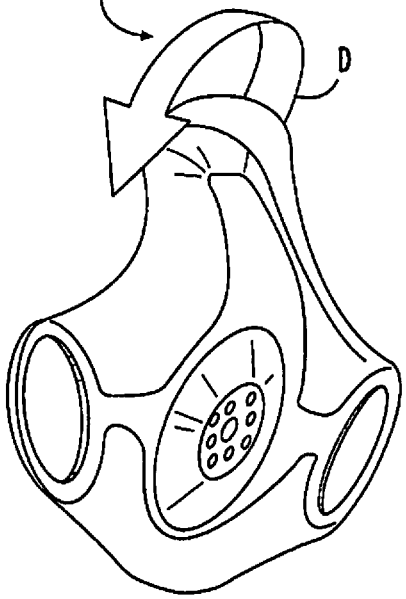
Figure 23:
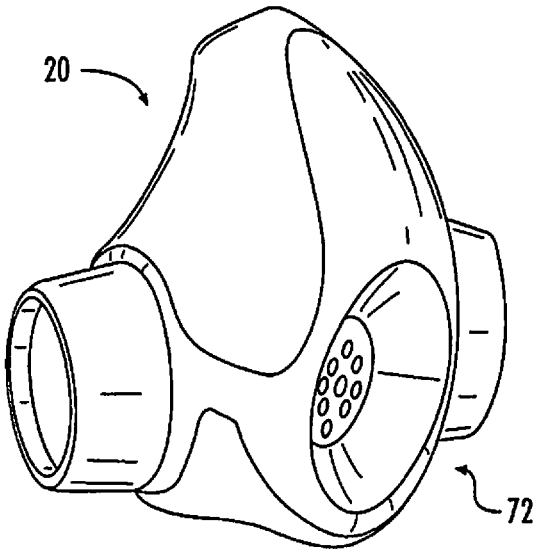
Figure 24:
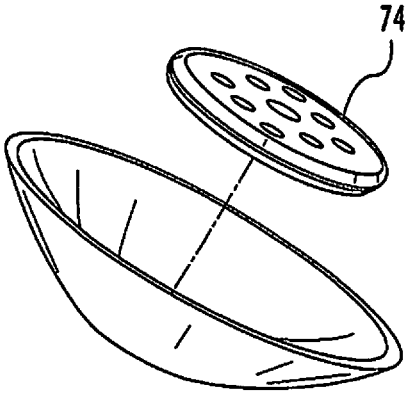

As seen in FIG. 17, the mask 100 includes improvements in fit accommodation and comfort having self adhesive seal 80 for difficult face forms. A protective sheet 82 may be peeled away from the adhesive seal 80 for application. Referring to FIG. 18, the mask 100 includes improvements in formable nasal strip for difficult nasal bridge issues. A collapsible support 84 within a nose section of the shaped molded base 20 is tightened with movement as shown in A-B, or expanded in the opposite direction of A-B. Referring to FIG. 19, the mask 100 includes improvements in gel based inserts 86 for seals and an additional formable part that allows user level fit issues and improved comfort and stability. Referring to FIG. 20, the mask 100 includes improvements in prolonged tolerability and improvements in facial pressure, and protection and respirator fit with the movement of an exoskeleton component 88 for fixing the placement of the shaped molded base 20. Additionally, as seen in FIGS. 21-24, longitudinal and lateral flexibility of the shaped molded base 20 is shown with arrows A-B-C-D (shown in FIGS. 21 and 22). Additionally, placement of the exhaust valve 72 and cover 74 with regard to the flexible shaped molded base 20 (shown in FIGS. 23 and 24).

Figure 25:
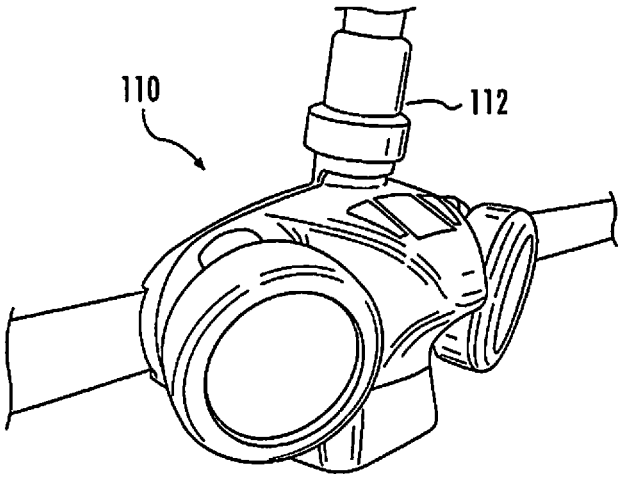
Figure 26:
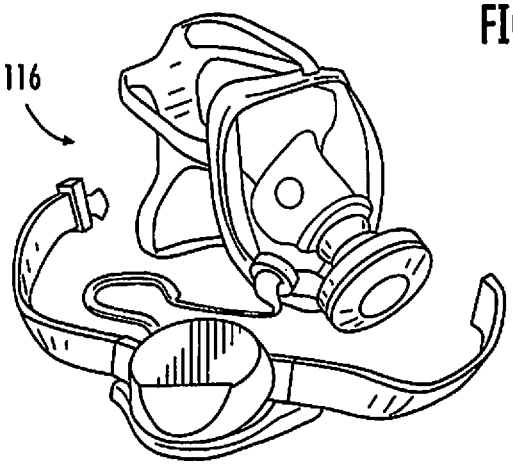
Figure 27:
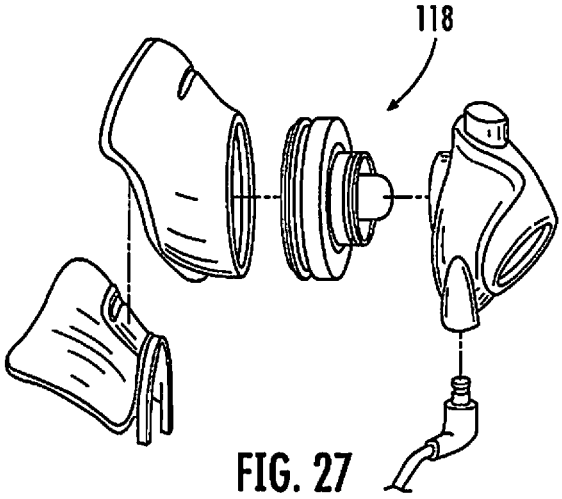
Figure 28:
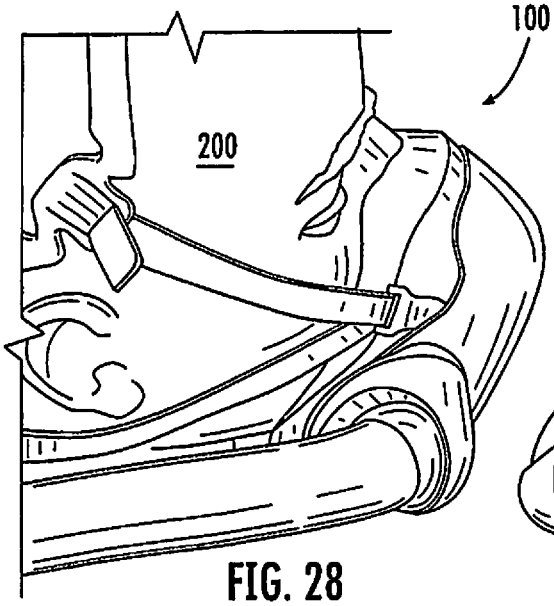
Figure 29:
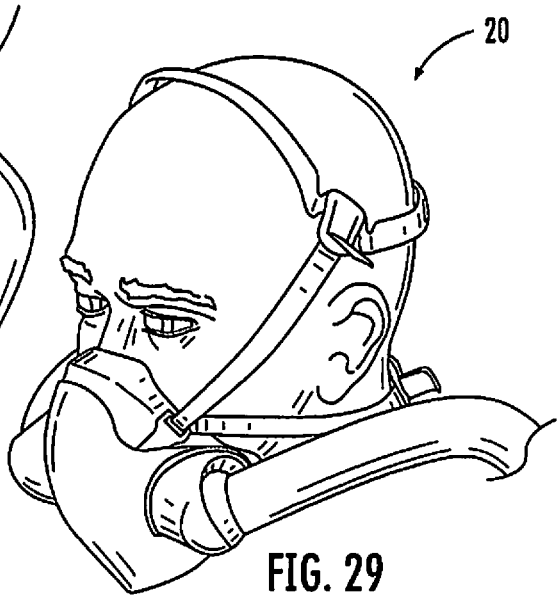

As seen in FIGS. 25-29, the invention includes the mask 100 which may combine with PAPR 110 applications having lower physiological burdens, e.g., cooling effect of blower or the work of breathing with supplied air 112 (shown in FIG. 25). Higher simulated workplace protection factor, such as an assigned Protection Factor (APF) of greater than 1000, swept back supply hose integration with lightweight and low profile for integration into health care worker personal protective ensembles 116 (shown in FIG. 26), respirator facial pressure low, directed exhalation path incorporated into supply system to capture/direct from patient, single battery charge per shift, and smooth supply hose surface for disinfection between uses, rotates on ball joint 118 (shown in FIG. 27) to move with wearer 200 (shown in FIG. 28-29). The mask 100 provides improvements in comfort and prolonged tolerability, breathing resistance, visual field, and gauging fit.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A semi-disposable face mask, comprising:

a shaped molded base, an entirety of the shaped molded base having an elastic composition selected from the group consisting of silicone, thermoplastic elastomer (TPE), and combinations thereof, the shaped molded base forming a face seal having a shape and having an outer perimeter opposite the face seal defining a shape and a maximum outer diameter of an entirety of the shaped molded base, the face seal having a different shape than the outer perimeter and not extending past the outer perimeter;

a filter media, the filter media having an outer perimeter defining a shape and a maximum outer diameter of an entirety of the filter media;

a ring-shaped framing member for supporting the filter media, the framing member being removably and directly coupled to the outer perimeter of the filter media; and a ring-shaped support structure, the support structure having an outer perimeter defining a shape and a maximum outer diameter of an entirety of the support structure, the support structure further having an inner perimeter defining a shape, the support structure being removably coupled to each of the framing member and the shaped molded base, the support structure extending around the outer perimeter of the shaped molded base to support the shaped molded base, the support structure and the framing member each extending around the outer perimeter of the filter media such that the filter media is directly exposed to an environment, the shape defined by the inner perimeter of the support structure matching the shape defined by the outer perimeter of the shaped molded base and the shape defined by the outer perimeter of the filter media, the shaped molded base and the filter media being in fluid communication to allow airflow from the environment through the filter media to the face seal.

2. The semi-disposable face mask of claim 1, wherein the shaped molded base has a composition of silicone.

3. The semi-disposable face mask of claim 1, wherein the shaped molded base has a composition of TPE.

4. The semi-disposable face mask of claim 1, wherein the face seal is a facial contact area selected from the group consisting of flat seal, reverse reflex seal, and standard reflex seal.

5. The semi-disposable face mask of claim 1, wherein the filter media is a high efficiency filtering media.

6. The semi-disposable face mask of claim 1, wherein the framing member frictionally locks into the support structure.

7. The semi-disposable face mask of claim 1, wherein the filter media is removably fixed within the framing member.

8. A face mask comprising:

a base, the base forming a face seal having a shape and having an outer perimeter opposite the face seal, the outer perimeter of the base defining a shape and defining a maximum diameter of an entirety of the base, the face seal having a different shape than the outer perimeter and not extending past the outer perimeter, the entirety of the base having an elastic composition selected from the group consisting of silicone, thermoplastic elastomer, and combinations thereof;

a filter media, the filter media having an outer perimeter, the outer perimeter of the filter media defining a maximum diameter of an entirety of the filter media, the maximum diameter of the base and the maximum diameter of the filter media being substantially the same, the filter media being expandable;

a ring-shaped framing member directly coupled to the outer perimeter of the filter media such that the framing member supports the expandable filter media, the framing member having an outer perimeter and being removably coupled to the expandable filter media; and a ring-shaped support structure, the support structure having an outer perimeter and being removably coupled to the outer perimeter of each of the framing member and the base, the support structure further having an inner perimeter defining a shape, the support structure extending around substantially the entire outer perimeter of the base to support an area of the base and such that the inner perimeter of the support structure and the outer perimeter of the base are at least substantially coextensive, the support structure and the framing member each extending around the outer perimeter of the expandable filter media such that the expandable filter media is directly exposed to an environment.

9. The face mask of claim 8, wherein the base includes a central aperture having a diameter, the diameter of the central aperture being less than the maximum diameter of the filter media.

* * * * *